United States Patent [19]

Wilson

[11] Patent Number: 4,687,078

[45] Date of Patent: Aug. 18, 1987

[54] HYDRAULIC ELEVATOR SYSTEM

[76] Inventor: Chester K. Wilson, 1302 Turtle Cove, Manchester, Mo. 63011

[21] Appl. No.: 877,157

[22] Filed: Jun. 23, 1986

[51] Int. Cl.[4] ..... B66B 11/04

[52] U.S. Cl. ..... 187/17; 91/443

[58] Field of Search ..... 187/1 R, 38, 17; 137/505.13; 91/443, 445, 447

[56] References Cited

U.S. PATENT DOCUMENTS 3,105,573 10/1963 Leveski ..... 187/38
4,601,366 7/1986 Blain ..... 187/17

FOREIGN PATENT DOCUMENTS 1456388 3/1965 Fed. Rep. of Germany ..... 187/17
51163 4/1979 Japan ..... 187/17
309834 8/1968 Sweden ..... 187/17

*Primary Examiner*—H. Grant Skaggs
*Assistant Examiner*—Kenneth Noland
*Attorney, Agent, or Firm*—Polster, Polster & Lucchesi

[57] ABSTRACT

In a hydraulic elevator system including a hydraulic cylinder, ram mounted in the cylinder and supporting an elevator car, a reservoir of hydraulic fluid and a return line connected to communicate with hydraulic fluid in the cylinder and the reservoir to permit the fluid to exhaust from the cylinder to the reservoir, a control valve assembly has an exhaust orifice communicating with the fluid in the hydraulic cylinder and with the reservoir, an exhaust piston for selectively closing and opening the orifice and a device responsive to pressure of the hydraulic fluid for limiting the amount by which the exhaust piston opens the orifice.

7 Claims, 4 Drawing Figures

HYDRAULIC ELEVATOR SYSTEM

BACKGROUND OF THE INVENTION

Hydraulic elevators have been used for many years. Before electric elevators were practical, hydraulic elevators were commonly operated by water, utilizing the pressure in city water mains and accumulators moving full load down at about 500 FPM. When reliable electric motors became available, the water driven hydraulic elevators were replaced over the years with oil driven systems in which hydraulic fluid (oil) was pumped from a reservoir, a supply tank, to the cylinder of the elevator to raise the ram, hence the elevator car. The fluid was then exhausted through a valve which could be opened and closed at a predetermined rate, but which was opened to a fixed effective area whenever it was opened. Under these circumstances the rate of descent of the car depended upon the head of oil and the weight of the car. In any event it has been slow with an empty car and relatively fast with full load. Conventionally, a hydraulic elevator descends at the rate of about 100 feet per minute with empty car.

The sytem of the present application is related in function to the system of patent Ser. No. 3,056,469, which makes use of a hydraulic system automatically to adjust the applied voltage on a generator shunt field so that the generator will generate the exact voltage to move the elevator at a constant rate of speed regardless of load on the elevator, up to 2000 feet per minute. The physical movement of the elevator and speed of the elevator are hydraulically computed together in order to generate a synchro signal.

One of the objects of this invention is to provide a hydraulic elevator system in which the maximum rate of descent is uniform, regardless of the head of fluid or the weight on the elevator car.

Another object is to provide such a system which is simple, economical, safe, effective, and versatile.

Still another object is to provide such a system that can easily be retrofitted at little expense and effort.

Other objects will become apparent to those skilled in the art in the light following and accompanying drawings.

SUMMARY OF THE INVENTION

In accordance with this invention generally stated, in a hydraulic elevator system that includes a hydraulic cylinder, a ram slidably mounted in the cylinder and extending from an open upper end of the cylinder to support an elevator car, a reservoir of hydraulic fluid communicating through a feed line to the interior of said cylinder, a pump operatively connected with the feed line to supply hydraulic fluid under pressure from the reservoir to the cylinder to cause the ram to move upwardly in the cylinder, a return connection to permit the fluid to exhaust from the cylinder, a control valve assembly is provided, operatively connected to the return connection. The control valve assembly includes a cylinder with an exhaust orifice communicating with fluid in the hydraulic cylinder and with the reservoir, a piston in the cylinder for selectively closing and opening the orifice, and means responsive to pressure of the fluid in the cylinder for limiting the amount by which the exhaust piston opens the orifice. In the preferred embodiment, the responsive means is actuated directly by the fluid, and includes a computer piston moved toward orifice closing position by the fluid against the bias of means biasing the computer piston in a direction away from orifice closing position.

DESCRIPTION OF THE PREFERRED EMBODIMENT

Figure 4:
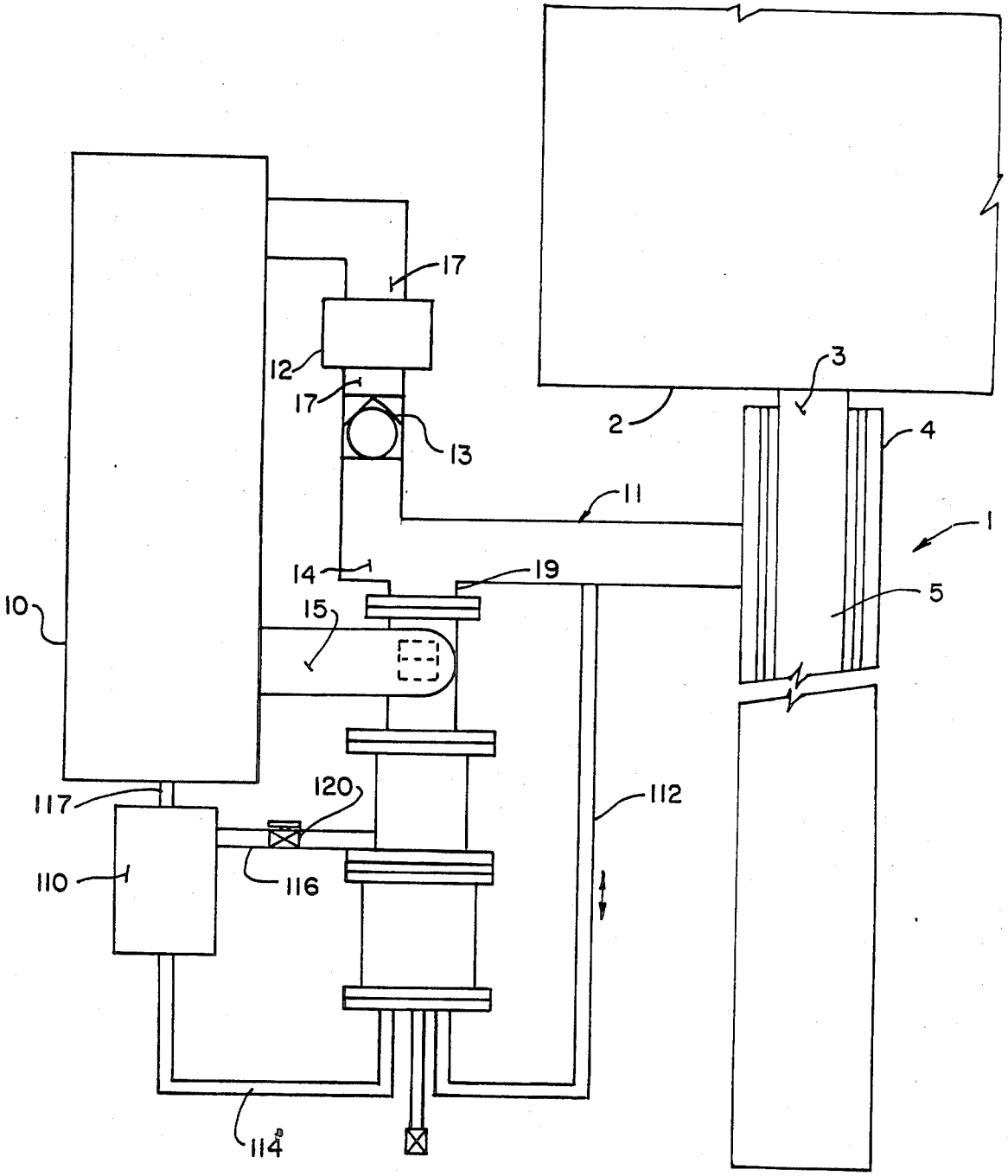
FIG. 4 is a somewhat diagrammatic view showing the control valve assembly installed in a hydraulic elevator system.

Referring now to the drawing for one illustrative embodiment of control valve assembly of this invention, and particularly to FIG. 4, reference numeral 1 indicates a hydraulic elevator system, including a car or cage 2, supported on an upper end of a ram or piston 3 extending through a large packing gland into an open end of a hydraulic cylinder 4 into which hydraulic fluid 5 is pumped. Conventionally, a feed line 11 communicates with the fluid in the cylinder 4 near the top of the cylinder, below the gland, the inside diameter of the cylinder being substantially larger than the diameter of the ram. In FIG. 4, for convenience, the feed line 11 is shown as having a tee 14 connected to a fitting, not here shown, communicating with the interior of the cylinder. The tee 14 is connected to a pump branch 17 of the feed line 11, and to a nipple 19 of a control valve assembly 20.

The pump branch 17 of the feed line 11 has in it a check valve 13 that opens in a direction toward the cylinder, and is connected to the discharge side of pump 12, the suction side of which is operatively connected to the supply tank 10. In practice, the feed line 11 is likely to be connected to the elevator cylinder by an elbow, and extend to a place relatively remote from the cylinder, where the tee 14 would be connected.

In this embodiment, the control valve assembly includes an orifice cylinder section 22, with an orifice cylinder 23 with an elongated cylindrical side wall 24 through which a rectangular orifice 25 extends. The orifice cylinder has at its upper end an upper flange 26 to which the flanged nipple 19 is bolted, and at its lower end, a lower flange 28. A nipple 31 is welded to the outer surface of the side wall 24 entirely around the orifice 25, and is connected to a return or exhaust line 15 that communicates with the supply tank 10.

A solid orifice piston 34 is slidably mounted in the bore of the orifice cylinder 23. The orifice piston has ring grooves 25 in which piston rings are seated, and a tapped hole 37 in its lower end.

The lower flange 28, which is larger in diameter than the upper flange 26, is bolted to an upper flange 44 of a control cylinder 42 of a control section 40. The control cylinder 42 has a side wall 46, through which a tapped hole extends, to receive a threaded end of a control line pipe fitting 47. The flanges 26 and 28 of the orifice cylinder 23 have an inside diameter coincident with the inside diameter of the cylinder side wall 24. However, the flange 44 has a relatively small opening in its center, large enough to accommodate a nut on a connecting rod 57, and its upper surfaces counterbored around the central opening to form a seat 43 to receive the lower end of the orifice piston 34 when the upper end of the orifice piston has cleared the orifice 25. A lower control cylinder section flange 48 has a central hole in it only large enough slidably to receive a computer rod 100. A control piston 49 is slidably mounted in the bore of the control cylinder 42. The control piston 42 has a cylindrical side wall with ring grooves 52 in its outside surface, in which piston rings 54 are seated, and a bottom wall 55 which is imperforate. A threaded connecting rod 57 is mounted on the upper surface of the bottom wall 55, and the upper end of the connecting rod 57 is screwed into the internally threaded socket 37 in the orifice piston 34. The effective length of the rod 57 between the bottom wall 55 and the orifice piston 34 can be adjusted by the amount the rod is screwed into the tapped hole, but in event, it should be of a length to produce a space between the lower surface of the bottom wall 55 and the upper surface of the flange 48, which space communicates with the hole in the side wall 46 in which the nipple 47 is mounted.

A computer section 68, mounted on the control section 42, has a computer cylinder 70, with a cylindrical side wall 71 to which upper flange 73 is welded. The upper flange 73 has an inside diameter coincident with that of the side wall 71. A closure-gland plate 74 is sandwiched between the upper flange 73 of the computer cylinder and the lower flange 48 of the control cylinder. The closure-gland plate 74 has an outside diameter coincident with that of the flanges 48 and 73, and a central opening coincident with the computer rod receiving opening in the flange 48. On its underside, the closure-gland plate 74 has, coaxial with the computer rod receiving opening, a packing gland 76. The gland 76 has a passage through which the rod 100 passes closely, and packing chamber 78, in which packing 80 is contained. At the lower end of the chamber 78, the inside wall defining the cavity 78 is internally threaded to receive a packing nut 81 by which the packing 80 is compressed to seal the rod 100 from the passage of fluid from the space below the bottom wall 55 of the control piston. The computer cylinder 70 has a lower flange 83, with an internal diameter coincident with the internal diameter of the cylinder side wall 71. The cylinder is closed at the bottom by a lower closure plate 84, bolted to the flange 83. Suitable gaskets, between all of the flanges of the assembly make the joints fluid tight. The lower closure plate 84 has three pipe nipples in three internally threaded passages through the plate, a computer line nipple 86, a computer return line nipple 87, and a drain nipple 88, equipped with a drain cock 89.

Figure 1:
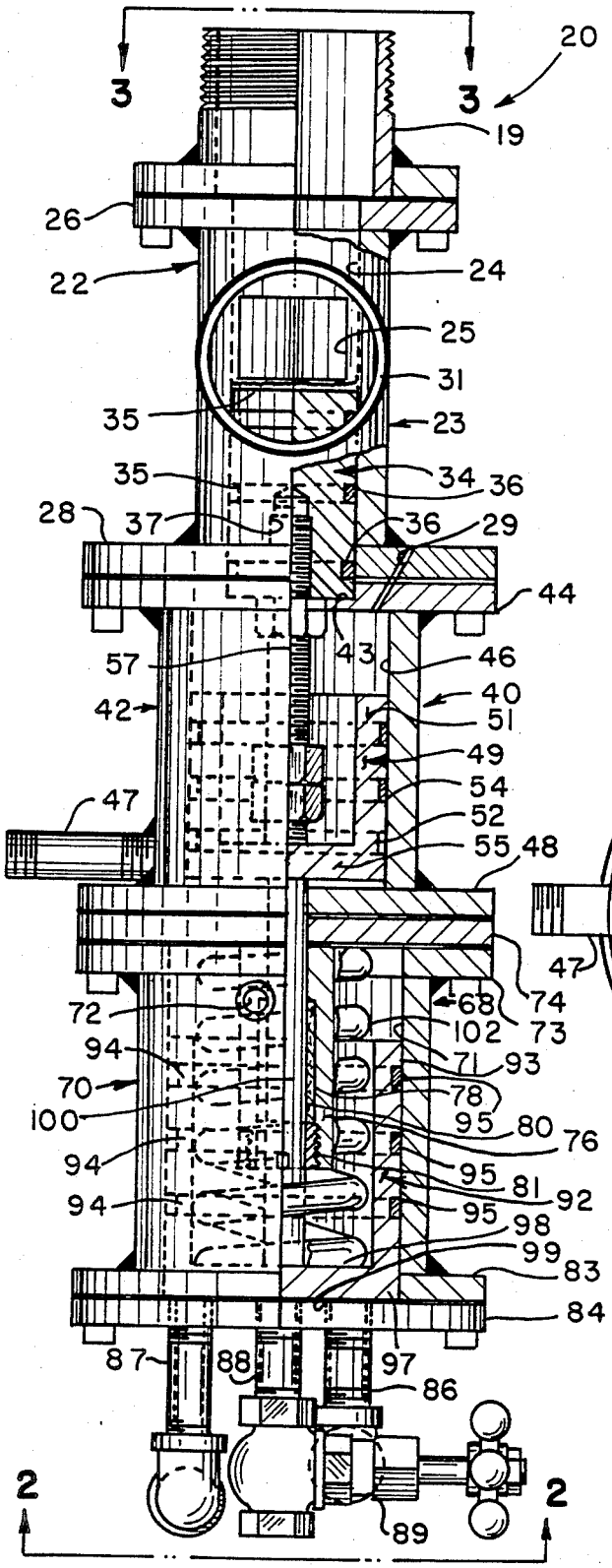
FIG. 1 is a view in side elevation, partly broken away and partly in section, of one illustrative embodiment of control valve assembly of this invention.
Figure 2:
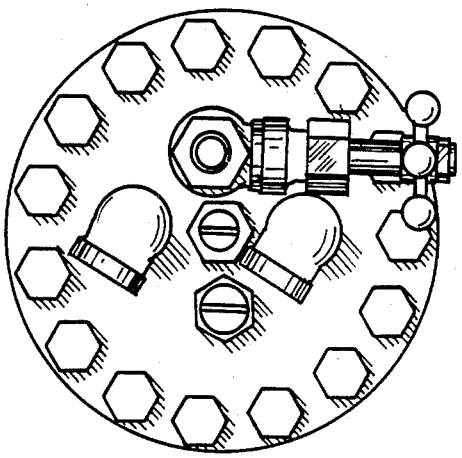
FIG. 2 is a view in bottom plan taken along the line 2—2 of FIG. 1.
Figure 3:
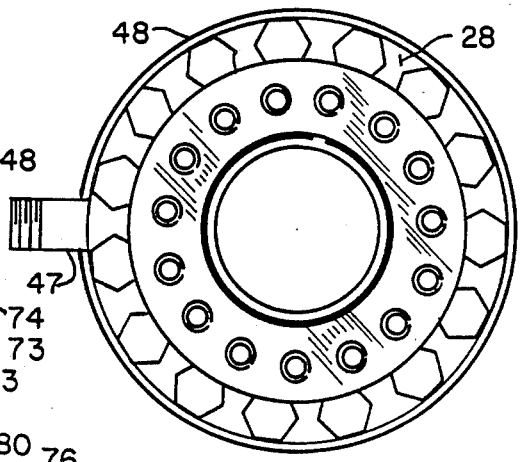
FIG. 3 is a top plan view taken along the line 3—3 of FIG. 1.

A computer piston 92 is slidably mounted in the computer cylinder 70. The computer piston 92 has a cylindrical side wall 93 with ring grooves 94 in it, in which piston rings 95 are seated, and an imperforate bottom wall 97 with an upper surface 98 and a lower surface 99. The computer push rod 100 is mounted in the center of the upper surface 98 of the bottom wall 97, and is surrounded by a heavy computer coil spring 102 that bottoms on the upper surface 98 and butts against the under surface of the closure-gland plate 74, all as shown in FIG. 1.

The computer line nipple 86 is connected to a computer line 112 which, as shown in FIG. 4, is connected to the tee 14 of the feed line 11. The computer return line nipple 87 is connected to a computer return line 114, which is connected at its other end to one inlet port of a solenoid operated three-way valve 110. Another port of the valve 110 is connected, by means of a control line 116 with the control fitting 47. A rate valve 120 is connected in the control line 116 between the three-way valve 110 and the nipple 47. An exhaust line 117 is connected to a third port in the three-way valve 110 and to the supply tank 10.

In operation, if the car 2 is to be raised, the pump 12 is started, which pumps hydraulic fluid from the tank 10 through the pump branch 17 of the feed line, through the check valve 13, which opens in a direction to permit the fluid to flow through the feed line 11 into the elevator cylinder 4. When the car 2 reaches its destination, the pump 12 is stopped. The check valve 13 closes to maintain the car at its desired position. This is conventional. If now, the car 2 is to be lowered, the three-way valve 110 is actuated to open the port to the exhaust line 117, to close the port to the computer return line 114, and to put the control line 116 into direct communication with the exhaust line 117. Because the pressure in the lines 112, 114 and 116 was at equilibrium, the computer piston 92 was forced to move against the bias of the computer spring 102 a distance upward which was a function of the pressure in the line 112, which was in turn, a function of the head of hydraulic fluid and the weight of the car 2 and any load thereon. In the rising condition of the elevator, and in its static condition, the control piston 49, in its uppermost position, is free of the computer rod 100. In the descending mode, the fluid in the control cylinder will exhaust, through the valve 120 and control line 116, to the supply tank 10, which is under atmospheric pressure. The rate at which that exhausting occurs, again, will be dependent upon the size of the opening provided by the rate valve 120. This determines the rate of acceleration of the car at the beginning of its descent. The rate of descent (velocity) of the car after its initial acceleration, will be determined by the effective size of the orifice 25, which, in turn, will be determined by the position of the computer rod 100. The greater the pressure, the higher the rod will move in the control cylinder, the higher the limit to which the piston 49 can move downwardly, hence the smaller the effective area of the orifice 25. The area of the lower surface 99 of the piston 92 is greater than the area of the bottom surface of the piston 49, which in turn, is, as has been explained, greater than the area of the upper surface of the orifice piston 34.

As will be appreciated, there is no hydraulic fluid in the space above the computer piston 92 within the computer cylinder 70, nor above the control piston 49 in the control cylinder 42. In the former, a port 72 is provided, simply to vent air, and in the latter, a port or vent 29 is provided extending from the interior of the cylinder 42 to the atmosphere, in the illustrative embodiment, through the flanges 28 and 44.

When the descent of the car is to be stopped, the solenoid of the three-way valve is de-energized to restore it to the original condition in which the computer return line 114 is connected to the control line 116, and the control line is cut off from communication with the tank. This will cause the control piston 49 to move up and close off the orifice 25, at a rate dependent upon the amount of restriction of the valve 120.

Merely by way of illustration, a control valve assembly with an orifice piston 1½" in outside diameter, an orifice 1.380 inches wide (in the circumferential direction) and 1.011 inches high (in the axial direction), forming an orifice 1.39 square inches in area, a control piston with an outside diameter of $2\frac{3}{8}''$ and a computer piston with an outside diameter of 2 13/16", and a 2" feed line 11 and return or exhaust line 15, and with a computer spring approximately 2 1/16" in diameter and $3\frac{3}{4}''$ long, made of $\frac{3}{8}''$ diameter spring steel stock, with a travel of $1\frac{1}{4}''$, it was found that an empty car weighing 12,000 lbs., resting on a $12\frac{5}{8}''$ diameter ram, produced a flow through the orifice of 260 gallons per minute, causing the car to move down at 40 feet per minute. With a 14,000 lb. load on the car, the orifice area was reduced by 34%, to pass the same amount of fluid, and keep the rate of descent at the same 40 feet per minute. With a 20,000 lb. load, 46% of the orifice area was closed off, permitting 260 gallons per minute to pass. As was indicated in the description of the operation, the control piston drops to the lowermost position permitted by the computer rod 100. The amount of the closing of the orifice, therefore, is dependent upon the position of the computer rod, which in turn, is determined by the amount of compression of the spring. The spring in the illustrative example was compressed only 15/32" when the car was loaded with 20,000 lbs. When the computer piston was blocked down so it could not raise up, thus leaving the 1.39" orifice wide open, with 20,000 lbs. on the car, creating a pressure of 256 lbs. on the orifice piston, the downspeed was 65 feet per minute, the orifice passing 421 gallons of oil per minute.

By using a larger orifice, the rate of descent can be made as high as is desired within the limits of the capacities of the feed and return lines and the size of the control valve assembly. A plurality of such valves can be used with a plurality of hydraulic cylinders and rams. In a large elevator system with a 16" ram, with a rate of descent of 300 feet per minute, if the car weight is 19,296 lbs., the pressure in pounds per square inch would be 96 lbs. on the orifice piston. In order to move the empty car at 300 feet per minute, the orifice would need to have an area of 16.73" (4" high and 4.1825" wide) and pass 3,132 gallons of oil per minute. If a load of 32,160 lbs. were placed on the car, making a total of 51,456 lbs., the pressure would now be 256 lbs. In order for the loaded car to move down at 300 feet per minute, the orifice passing 3,132 gallons of oil per minute, 46% of the orifice area would have to be blocked off. The computer piston would push the computer rod up 46% of the total orifice. It will require a 6" feed line and a 16.73 square inch orifice valve to accommodate this flow. The 6" piston will have a downward thrust of 7,237 lbs. on the computer rod. The computer piston can be 7" in diameter, giving it an upward thrust of 9,850 lbs. The computer spring would need a downward thrust of 2,613 lbs. in order to hold the orifice piston 46% closed. Six springs, each approximately 2 3/16" in diameter and $5\frac{3}{4}''$ long can be spaced around the computer rod. Each spring has a downward thrust of 435 lbs. when the orifice piston has risen to the place at which it blocks off 46% of the orifice, which is 4" high. Under these circumstances, the orifice piston will have been held at a position 1.840 inches from the open most position.

If there is some adjustment to be made in the speed of descent, it can be made by using shims between the computer spring and one of the surfaces on which it bears. In this illustrative embodiment, the control piston could also be 7" in diameter, and would push the orifice piston up $4\frac{1}{2}''$, which is $\frac{1}{2}''$ above the top of the orifice. To do so, it will require 173.16 cubic inches of oil to fill the control cylinder, and therefore it would be impossible for the valve to slam open and closed.

Numerous variations in the construction of the device of this invention, within the scope of the appended claims, will occur to those skilled in the art of the light of the foregoing disclosure. Merely by way of example, other means of sensing the superincumbent pressure, and moving limit means in response thereto can be employed, although the means shown and described have great advantages of simplicity, economy and reliability over other such sensing and limiting means. In the case of a very large orifice, stiffening or reinforcing ribs can be provided, which can also serve to ensure that the orifice piston is properly guided. These are merely illustrative.

I claim:

1. In a hydraulic elevator system including a hydraulic cylinder, a ram slidably mounted in said cylinder and extending from an open upper end of said cylinder to support an elevator car, a reservoir of hydraulic fluid communicating with said cylinder, fluid pressure means operatively connected to supply hydraulic fluid under pressure from said reservoir to said cylinder to cause said ram to move upwardly in said cylinder, and valve means connected to exhaust fluid under pressure from said cylinder to said reservoir, a control valve assembly for controlling the descent of said elevator car comprising an exhaust orifice communicating with fluid in said hydraulic cylinder, orifice piston means for selectively closing and opening said orifice, means responsive to pressure of said fluid for limiting the amount by which said orifice piston means opens said orifice, said responsive means comprising a computer piston moved to orifice closing position by said fluid and biasing means of biasing said computer piston in a direction away from orifice closing position, and a control cylinder, a control piston in said control cylinder operatively connected to said orifice piston, a rod carried by said computer piston and extending slidably into said control cylinder, and a computer line communicating with said hydraulic cylinder fluid and said computer cylinder, whereby the hydraulic cylinder fluid under pressure moves said computer piston in response to said pressure, to move said rod to limit the movement of said control piston.

2. The system of claim 1 wherein the said control piston is connected to said orifice piston by connecting means by which the distance between said control piston and orifice piston can be adjusted.

3. The system of claim 2 wherein said connecting means is a threaded connecting rod supported on a surface of the control piston and in an internally threaded socket in the orifice piston.

4. The system of claim 3 wherein the said ram is $12\frac{5}{8}$ inches in diameter, said orifice piston, 1 and $\frac{1}{2}$ inches in outside diameter, said orifice, 1.380 inches wide and 1.011 inches high, providing an opening about 1.395 square inches in area, said control piston has an outside diameter of $2\frac{3}{8}$ inches, said computer piston has an outside diameter of 2 13/16 inches, 2 inch feed and exhaust lines being connected to said fluid pressure means and control valve, respectively, said spring being approximately 2 1/16 inches in diameter and $3\frac{3}{4}$ inches high, $\frac{3}{8}$ inch diameter spring steel stock with a travel of about $1\frac{1}{4}$ inches and said elevator car weighing, empty, on the order of 12,000 pounds, said control valve producing a flow through said orifice of 260 gallons per minute regardless of the load on said car.

5. The system of claim 1 wherein said biasing means comprises at least one heavy, helical computer coil compression spring.

6. In a hydraulic elevator system including a hydraulic cylinder, a ram slidably mounted in said cylinder and extending from an open upper end of said cylinder to support an elevator car, a reservoir of hydraulic fluid communicating with said cylinder below said ram, fluid pressure means operatively connected to supply hydraulic fluid under pressure from said reservoir to said cylinder to cause said ram to move upwardly in said cylinder, an exhaust line connected to communicate with hydraulic fluid in said cylinder and said reservoir to permit said fluid to exhaust from said cylinder to said reservoir, and means for controlling the descent of said elevator car, the improvement comprising a control valve assembly between the said cylinder and said exhaust line, said control valve assembly having an elongated orifice cylinder section communicating at its upper end with fluid in said elevator cylinder, said orifice cylinder having an orifice in a side wall communicating with said exhaust line; a cylindrical orifice piston slidably mounted in said orifice cylinder and means for sealing said orifice piston against substantial leakage of said fluid between said orifice cylinder and said piston, said piston being dimensioned and arranged to move between a position at which it closes said orifice and a position at which it opens said orifice; a control cylinder mounted axially concentrically with said orifice cylinder; a control piston slidably mounted in said control cylinder, said control piston being of larger diameter than the said orifice piston, and means for sealing said control piston against substantial leakage between said control cylinder and said control piston, said control piston being connected to said orifice piston for moving said orifice piston between orifice closing and orifice opening position; a control line communicating with the interior of said control cylinder for admitting said fluid between said control piston and said control cylinder bottom wall; a cylindrical computer cylinder, axially coaxial with said control cylinder, having side and bottom walls; a computer piston slidably mounted in said computer cylinder, said computer piston having a larger diameter than said control piston, and means for sealing said computer cylinder against substantial leakage between said computer cylinder and said computer piston; a computer line communicating with said hydraulic cylinder fluid in said computer cylinder for admitting said fluid to said computer cylinder between said bottom wall and said computer piston; biasing means for biasing said computer piston in a direction toward said computer cylinder bottom wall; means carried by said computer piston engaging said control piston for limiting the travel of said control piston in a direction away from said orifice piston; a computer return line connected to communicate with fluid in said computer cylinder between said computer piston and said computer cylinder bottom wall and directing means connected to said computer return line, to said control line and to said reservoir for selectively (1) connecting said computer return line to said control line and closing off said control line from communication with said reservoir, and (2) for connecting said control line to said reservoir and closing said computer return line.

7. The improvement of claim 6 including selectively variable restricting means in said control line.

* * * * *